US005705472A

United States Patent [19]

Hayes et al.

[11] Patent Number: 5,705,472

[45] Date of Patent: Jan. 6, 1998

[54] NEUTRAL AQUEOUS CLEANING COMPOSITION

[75] Inventors: Michael E. Hayes, Fernandina Beach; Elizabeth A. Bivins, Jacksonville; Jacquelyn B. Coleman, Yulee, all of Fla.

[73] Assignee: Petroferm Inc., Fernandina Beach, Fla.

[21] Appl. No.: 503,810

[22] Filed: Jul. 18, 1995

[51] Int. Cl.[6] ..... C11D 1/72; C11D 1/835; C11D 3/43; B08B 3/04

[52] U.S. Cl. ..... 510/423; 510/421; 510/433; 510/434; 510/500; 134/40; 134/42

[58] Field of Search ..... 510/421, 423, 510/433, 434, 500; 134/40, 42

[56] References Cited

U.S. PATENT DOCUMENTS

| | | | |
|---|---|---|---|
| 2,976,248 | 3/1961 | Otrhalek | 252/156 |
| 3,879,216 | 4/1975 | Austin | 134/4 |
| 3,956,197 | 5/1976 | Schoenholz et al. | 252/526 |
| 4,147,652 | 4/1979 | Kaniecki | 252/156 |
| 4,207,215 | 6/1980 | Bolan | 252/542 |
| 4,302,364 | 11/1981 | Gosset et al. | 252/545 |
| 4,578,208 | 3/1986 | Geke et al. | 252/135 |
| 4,597,887 | 7/1986 | Colooney et al. | 252/106 |
| 4,599,116 | 7/1986 | King et al. | 134/2 |
| 4,627,931 | 12/1986 | Malik | 252/153 |
| 4,873,002 | 10/1989 | Ibrahim | 252/8.8 |
| 5,039,441 | 8/1991 | Thomas et al. | 252/142 |
| 5,039,451 | 8/1991 | Phillips et al. | 252/356 |
| 5,076,954 | 12/1991 | Loth et al. | 252/122 |
| 5,158,710 | 10/1992 | Vaneenam | 252/539 |
| 5,192,460 | 3/1993 | Thomas et al. | 252/142 |
| 5,196,146 | 3/1993 | Farella et al. | 252/542 |
| 5,290,472 | 3/1994 | Michael | 252/170 |
| 5,294,364 | 3/1994 | Thomas et al. | 252/142 |
| 5,403,515 | 4/1995 | Instone et al. | 252/550 |
| 5,468,423 | 11/1995 | Garabedian, Jr. et al. | 252/546 |

FOREIGN PATENT DOCUMENTS

| | | | |
|---|---|---|---|
| 2110364 | 9/1994 | Canada | C23G 1/02 |

*Primary Examiner*—Paul Lieberman
*Assistant Examiner*—Gregory R. DelCotto
*Attorney, Agent, or Firm*—Synnestvedt & Lechner

[57] ABSTRACT

An aqueous cleaning composition having a pH of about 6 to about 8 and comprising a solution of the following ingredients: water, an organic solvent and an imidazoline-based cationic surfactant, each present in an amount effective to dissolve adherent soils from a substrate; and a nonionic surfactant in an amount sufficient to maintain said cationic surfactant in solution; and also a weak organic acid in an amount sufficient to impart to the composition said pH; wherein said composition is substantially free of any material which has an ozone-depletion factor of greater than about 0.15 and wherein said composition is substantially free of any material which would tend to form a solid with any of the ingredients comprising the composition, and its use to clean metallic and non-metallic surfaces.

18 Claims, No Drawings

NEUTRAL AQUEOUS CLEANING COMPOSITION

FIELD OF THE INVENTION

This invention relates to a neutral aqueous cleaning composition which is suitable for cleaning a wide variety of soils from a wide variety of substrates. The term "neutral"means that the aqueous cleaning composition of this invention has a pH of about 6 to about 8.

In the cleaning industry, different types of cleaning compositions are being developed to replace chlorinated hydrocarbon solvents which are ozone-depleting materials. A chlorofluorocarbon (CFC) is an example of a material which has excellent cleaning properties, but which is an ozone-depleting material. Chlorinated hydrocarbon solvents have gained wide usage in the cleaning industry because they are solvents for a wide variety of soils and because they can be used effectively to clean a wide variety of substrates. The use of such chlorinated hydrocarbon solvents, however, presents a threat to the environment because such materials are involved in stratospheric ozone depletion. Therefore, alternative cleaning compositions that do not contain chlorinated hydrocarbon solvents are environmentally attractive.

Aqueous cleaning compositions have long been known in the cleaning industry. Only recently, however, have these aqueous compositions been considered as substitutes for environmentally detrimental hydrocarbon-based solvents such as CFC-containing cleaning compositions. Aqueous cleaners may be used to clean a variety of greases, oils and other soils from metal, plastic, glass, or other bare or finished surfaces. The majority of aqueous cleaners available today are either acidic (pH less than about 6) or alkaline (pH greater than about 8) in nature. Although acidic and alkaline cleaners can function effectively in a limited number of cleaning situations, there are many substrates for which acidic and alkaline cleaners can not be used effectively.

Alkaline Cleaning Compositions

The use of alkaline cleaning compositions has quite a few disadvantages. For example, their use is limited to a narrow range of substrates and soils. Although certain types of soils are cleaned well by alkaline cleaners (e.g. fatty oils), other soils are cleaned very poorly. Accordingly, plants using aqueous alkaline cleaners typically require several cleaning lines for different types of soils.

Additionally, alkaline cleaners cannot be used effectively on all types of substrates as they tend to be corrosive to many metals. For example, alkaline cleaners cannot be used effectively to clean aluminum substrates, because the alkaline cleaner will attack and damage the aluminum surface. Other metal surfaces are also vulnerable to attack by alkaline cleaners. Indeed, many alkaline cleaners of the prior art cannot be used on metal substrates and are suitable only for glass. For example, U.S. Pat. No. 2,976,248 discloses the cleaning of glass jars with an alkaline cleaner which contains an inhibitor to reduce corrosion of the mild steel conveyor belt employed in transferring the bottles through the washer mechanism. U.S. Pat. No. 4,147,652 discloses also the cleaning of glass bottles with an alkaline cleaner concentrate which is of relatively high alkalinity and optionally contains a chelating agent to prevent scale formation from hard water metal ions.

Although some alkaline cleaners are used to clean metal parts, corrosion inhibitors are often added to the cleaner in order to limit the corrosion of the metal part being cleaned. Typical alkaline cleaners with corrosion inhibitors may limit further oxidation, but these cleaners do not reverse or remove existing oxidized metal. Metals cleaned with such alkaline cleaners are not brightened to the desired extent.

Although the corrosion inhibitors may limit corrosion, soft metals are vulnerable to discoloration. This often necessitates the use of an acidic rinse after the cleaning process in order to brighten the metal for customer acceptability.

A process of cleaning a soft metal such as aluminum with an alkaline cleaning composition is disclosed in U.S. Pat. No. 4,599,116 to King et al. The operating pH of this cleaner ranges from about 10–13. This alkaline cleaner comprises an alkalinity agent such as an alkali metal hydroxide or an alkali metal carbonate, a complexing agent such as a sugar acid or its salt, and a surfactant or blend of surfactants. In order to prevent discoloration from forming on the aluminum cleaned substrate, the aluminum surface is rinsed with an acidic rinse solution after contact with the alkaline cleaner.

For sensitive metals, addition of a corrosion inhibitor to the alkaline cleaner may not be sufficient protection against surface attack by the cleaner. A different cleaner may thus be needed to clean sensitive metals, again, increasing the number of cleaning lines required if both sensitive and non-sensitive metals are processed.

Additional disadvantages associated with alkaline cleaners include adverse effects on the environment and the requirement of special handling due to alkalinity and potential health and safety problems.

Acidic Cleaning Compositions

Acidic aqueous cleaners have also been used in the cleaning industry. Like alkaline cleaners, acidic cleaners, too, are only effective in dissolving limited types of soils and can be used effectively on but a limited number of substrates. For example, acidic aqueous cleaners may be used to clean metal oxide or rust from a metal surface; however, such acidic cleaners may not be used safely on all metal surfaces. Acidic solutions can corrode the surface of any substrate which is not acid-resistant. Additionally, the handling of such acidic cleaners requires a significant degree of care since these cleaners can be caustic to flesh and can corrode rubber hosing, pumps, concrete, or pipes. There are also significant environmental limitations on the disposal of such cleaners, due to their high acidity.

The acidic cleaner which is the subject of U.S. Pat. Nos. 5,039,441, 5,192,460, and 5,294,364 to Thomas et al. is described as being useful to remove soap scum, lime scale and grease only from porcelain and enamel ware. This acidic cleaning composition has a pH from about 1–4 and comprises a mixture of anionic and nonionic detergents, organic, aminoalkylene phosphonic, and phosphoric acids, and water.

U.S. Pat. No. 5,076,954 to Loth et al. discloses in Example 3 therein an acidic oil-in-water microemulsion which is used to clean shower wall tiles of lime scale and soap scum. This acidic cleaner has a pH of about 2.5 and comprises sodium paraffin sulfonate, a nonionic alcohol ethoxylate, magnesium sulfate hydrate, a mixture of succinic, glutaric, and adipic acids, perfume, and water. The mixture of acidic agents in this acidic cleaner can damage the surface of materials which are not acid resistant.

Canadian Patent No. 2,110,364 to Ouyang et al. discloses a weak acid cleaning composition which comprises citric acid, a hydrocarboxylic acid salt, a nonionic surfactant, and a coupling agent. This weak acid cleaner can be used to remove light molecular weight lubricant oils soils from aluminum, cold rolled steel, and galvanized steel.

Due to the limited versatility of alkaline and acidic cleaners, a typical product line of such cleaners invariably includes several different cleaning compositions, each of which is tailor made for cleaning limited types of soils from limited types of substrates. Additionally, special care must be taken by the user when working with such caustic compositions as they can be harmful to human skin. In industrial processes, the use of alkaline or acidic aqueous cleaners carries the additional disadvantage of requiring the costly step of neutralization before disposal.

There are, therefore, disadvantages associated with using cleaning compositions of the prior art, including the ozone depletion associated with CFCs and limited usage range of alkaline and acidic aqueous cleaning compositions. Accordingly, there is a need in the cleaning industry for a non-ozone depleting cleaning composition which can be used effectively to clean a broad range of soils from a broad range of substrates. The present invention is directed to a neutral aqueous cleaning composition which is suitable for cleaning a wide variety of soils from a wide variety of substrates and which is environmentally attractive.

Reported Developments

Neutral aqueous cleaning compositions (pH of about 6 to about 8) are presently known in the industry. For example, U.S. Pat. No. 5,403,515 to Instone et al. discloses an aqueous liquid cleaning composition having a pH from 6–8 and comprising 20–40 wt. % surfactant and magnesium. The surfactant comprises primary alcohol sulphate and non-ionic surfactants. The major surfactant component in this cleaning composition is a magnesium salt of primary alcohol sulphate. This patent also teaches that typical formulations further comprise a solvent other than water, including propylene glycol ethers, alcohols, ethylene glycol ethers, and mixtures thereof. An essential component of this neutral cleaning composition is the magnesium salt of primary alcohol sulphate.

Another neutral aqueous cleaning formulation is disclosed in U.S. Pat. No. 5,196,146 to Farella et al. This patent discloses an aqueous formulation which is used for cleaning grease and oil from metal, plastic, glass or other surfaces and which includes water, a surfactant, and a corrosion-inhibiting amount of a 2-piperazinone. The composition of Example 3 has an optimum pH of 7.25 and is used to clean calcium grease from a steel surface. U.S. Pat. No. 5,076,954 to Loth et al. discloses a stable microemulsion cleaning composition which can be neutral in pH. In particular, Example 1 of this patent discloses a cleaning composition which has a pH of about 7.0 and which can be used to solubilize cooking oil and to clean a painted wood surface smeared with a greasy deposit of lard.

The cleaning composition of Example 1 comprises a sodium paraffin sulfonate, a nonionic alcohol ethoxylate, ethylene glycol monobutyl ether, perfume, magnesium sulfate hydrate, and water.

U.S. Pat. No. 4,302,364 to Gosset et al. discloses aqueous cleaning compositions, some formulations of which may be neutral. This cleaning composition comprises from about 35–65% of a ternary surfactant mixture containing an anionic, an ethoxylated nonionic, and a cationic surfactant, an organic solvent, and water. An embodiment of this composition has a pH ranging from about 6–7.5 and comprises a polyacid in addition to the aforementioned constituents.

Another neutral aqueous cleaning composition is disclosed in U.S. Pat. No. 4,578,208 to Geke et al. in that embodiments of the composition have a pH within the range of 7.5–10.5.The composition comprises a phosphoric acid ester, an alkanolamine, at least one sprayable nonionic surfactant and optionally, builders, non-ferrous metal inhibitors, and/or biocides.

The neutral cleaners taught by the prior art have a variety of shortcomings. For example, their cleaning versatility is limited and their brightening ability is often less than satisfactory. Accordingly, the present invention relates to an improved neutral aqueous cleaning composition.

SUMMARY OF THE INVENTION

In accordance with this invention, there is provided an aqueous cleaning composition having a pH of about 6 to about 8 and comprising a solution of the following ingredients: water, an organic solvent and an imidazoline-based cationic surfactant, each present in an amount effective to dissolve adherent soils from a substrate; and a nonionic surfactant in an amount sufficient to maintain said cationic surfactant in solution; and also a weak organic acid in an amount sufficient to impart to the composition said pH; wherein said composition is substantially free of any material which has an ozone-depletion factor of greater than about 0.15 and wherein said composition is substantially free of any material which would tend to form a solid with any of the ingredients comprising the composition.

In preferred form, the aqueous cleaning composition of this invention has a pH of about 6 to about 8 and comprises a solution of: (A) about 30 to about 68 wt. % water; (B) about 25 to about 55 wt. % of organic solvent for dissolving adherent soils from a substrate and for stabilizing the cleaning composition; (C) about 5 to about 10% of an imidazoline-based cationic surfactant for dissolving adherent soils from a substrate and for brightening the surface of soft metals; (D) about 1 to about 5 wt. % of a nonionic surfactant for maintaining the cationic surfactant in solution; and (E) a weak organic acid for imparting to the composition the desired pH; wherein said composition is substantially free of any material which has an ozone-depletion factor of greater than about 0.15 and wherein said composition is substantially free of any material which would tend to form a solid with any of the ingredients comprising the composition.

Also, in preferred form, the organic solvent comprises about 20 to about 40 wt. % of a water-soluble glycol ether and about 4 to about 15 wt. % of a water-insoluble glycol ether.

Another aspect of the present invention comprises a method of removing soil from a substrate comprising the step of contacting the substrate with the cleaning composition of the present invention. The cleaning composition can be used in undiluted form or it can be diluted with additional water, for example, with 50 wt. % or more of water.

The cleaning composition of the present invention has a number of advantages associated with its use. It is environmentally attractive for a number of reasons. It is effective in the absence of the use of chlorinated hydrocarbon solvents or other hydrocarbon materials which function as ozone depleters. Waste disposal of the neutral aqueous cleaner of the present invention is more efficient relative to that involving acid or alkaline cleaners.

In addition to the environmental advantages of the neutral aqueous cleaning composition of the present invention, there are other advantages which flow from its use. The present composition can be used to clean a relatively broad spectrum of substrates containing a relatively wide array of soils. The present cleaning composition can be used effectively on any type of metallic or non-metallic substrate. In particular, while alkaline cleaners can not be used safely on aluminum substrates, the neutral cleaner of the present invention can be used safely to clean an aluminum substrate without adversely affecting the surface. The neutral aqueous cleaner of the present invention is particularly well-suited for substrates made of copper and brass, producing a shiny, corrosion-free surface after cleaning and drying. The neutral aqueous cleaner of the present invention also provides corrosion-inhibition to certain types of steel that are prone to being corroded by other acidic or alkaline aqueous cleaners.

Furthermore, the cleaning composition of the present invention has the additional advantage of being able to solubilize a relatively large quantity of oil. The cleaning effectiveness of the present cleaner does not deteriorate significantly when loaded down with oil. This characteristic permits the present cleaner to be used for relatively long periods of time without needing to be replaced, thus increasing its efficiency in industrial settings relative to other popularly used cleaners.

DETAILED DESCRIPTION OF THE INVENTION

The cleaning composition of the present invention is a solution in which all of the ingredients are dissolved or miscible with each other.

An essential ingredient of the aqueous cleaning composition of the present invention is water. This constituent functions to dissolve any number of different types of soils that tend to be present on substrates that need to be cleaned. In addition, water functions as the principal carrier for other of the ingredients of the composition. Deionized water is used preferably.

Water comprises preferably about 30 to about 68 wt. %, and more preferably, about 50 to about 60 wt. % of the composition. In a particularly preferred form, water is present in an amount greater than any other ingredient.

Accordingly, water comprises the major constituent of a preferred form of the composition. The use of such a large percentage of water offers an economic advantage in formulating the neutral aqueous cleaner, since water is the least costly ingredient in the composition.

The cleaning composition of the present invention includes also an organic solvent, but an organic solvent that is not an ozone-depleter. Indeed, the cleaning composition of the present invention is substantially free of any materials that are considered to be ozone depleters. Accordingly, the constituents comprising the composition, including the solvent(s) present in the composition, have an ozone-depletion factor (ODP) of no greater than about 0.15, more preferably no greater than about 0.05, and even more preferably about zero. Ozone depletion factors are reported in *Technical Progress On Protection The Ozone Layer—Electronics, Degreasing and Dry Cleaning Solvents Technical Options Report*, United Nations Environment Programme (Jun. 30 1989).

Any organic solvent or mixture of organic solvents which are not ozone depleters and which are capable of cleaning the involved soils from the substrates to be cleaned can be used in the composition of the present invention. The selection of the solvent, taking into account the nature of the soil(s), is within the ability of one skilled in the art.

In preferred form, the organic solvent is effective in dissolving oils and greases and functions in a manner such that the cleaning composition continues to solubilize soils from the substrates even though the composition contains a relatively large amount of soils. The cleaning effectiveness of the cleaning composition of the present invention does not deteriorate even after it has been contaminated with oil up to about 8% by weight. In the composition of the present invention, this soil loading capacity is accomplished preferably by use of a combination of a water-soluble organic solvent and a water-insoluble organic solvent.

The water-soluble organic solvent functions as a solvent for oils and greases and allows the cleaning composition of the present invention to solubilize a large quantity of soilant removed from the soiled substrates during the cleaning process. This ingredient also stabilizes the mixture and helps keep it together during adverse shipping and storage conditions (heating and cooling).

Preferred water soluble organic solvents for use in the composition of the present invention include glycol ethers, more preferably propylene glycol ethers. Suitable propylene glycol ethers include, for example, propylene glycol n-propyl ether, propylene glycol monomethyl ether, dipropylene monomethyl ether, and tripropylene glycol monomethyl ether. An especially preferred water-soluble propylene glycol ether is tripropylene glycol monomethyl ether. This ether is commercially sold by Dow Chemical Company as Dowanol TPM.

The water-insoluble organic solvent functions as a stabilizer, which couples the cleaning composition together during freezing and prevents separation upon thawing. Water insoluble organic solvents suitable for use in the composition of the present invention are glycol ethers, more preferably propylene glycol ethers, which may be up to 20% soluble in water. An especially preferred water-insoluble glycol ether is propylene glycol n-butyl ether. Such ether is commercially sold by Dow Chemical Company as Dowanol PnB. Additional water insoluble organic solvents suitable for use in this invention include alcohols, such as, for example, isobutyl alcohol.

In preferred form, the organic solvent is present in a minor amount relative to the water constituent of the composition, but is present in a major amount relative to the other non-aqueous constituents of the present invention. In particularly preferred form, the organic solvent comprises about 24 to about 55 wt. % of the composition. In the use of a combination of water-soluble and water-insoluble glycol ethers, the water-soluble glycol ether comprises preferably about 20 to about 40 wt. % of the composition, more preferably about 35 to about 38 wt. % of the composition, and the water-insoluble glycol ether comprises preferably about 4 to about 15 wt. % of the composition.

In addition to the aforementioned constituents, the aqueous cleaning composition of the present invention is formulated also from a combination of surfactants, namely a cationic surfactant and a nonionic surfactant. The use of the cationic surfactant functions in cleaning the surface of soils and in brightening the surface of soft metals. The use of the nonionic surfactant improves the mutual miscibility of the components comprising the composition.

Although any suitable cationic surface active agent can be used to accomplish the aforementioned functions, it is preferred to use an imidazoline-based cationic surfactant. An imidazoline-based cationic surfactant is a cationic surfactant which includes an imidazoline group, represented as follows:

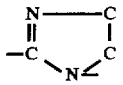

In preferred embodiments, the cationic surfactant is a 1-hydroxyethyl-2-alkylimidazoline, which is oil soluble and water dispersible. This molecule is represented as follows:

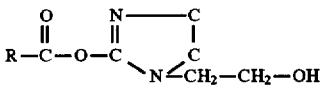

R represents a radical having about 7 to about 17 carbon atoms, with R=17 a preferred embodiment. Most preferably the imidazoline-based cationic surfactant is 1-hydroxyethyl-2-oleyl imidazoline, wherein $R=CH_3-(CH_2)_7-CH_2=CH_2-(CH_2)_7$). hereafter, for convenience, referred to also as "the imidazoline". The amount of imidazoline-based cationic surfactant comprising the composition should preferably be from about 5 to about 10 wt. %.

It has been observed that the imidazoline-based cationic surfactant tends to form solids in a composition of the type to which this invention relates, but a composition which does not contain a nonionic surfactant. It is believed, but not confirmed, that the cationic surfactant undergoes hydrolysis and that the product(s) of hydrolysis is not soluble in the neutral composition. It is believed also that the nonionic surfactant solubilizes or aids in solubilizing the product(s) of the hydrolysis of the imidazoline-based cationic surfactant. In any event, the use of the term "imidazoline- based cationic surfactant" or genus or species thereof encompasses within its meaning the compounds thereof or products of reaction formed in the composition.

Although any suitable nonionic surface active agent can be used to accomplish the aforementioned, it is preferred to use an ethoxylated nonionic surfactant in the composition of this invention, for example, a nonionic alcohol ethoxylate. Preferred alcohol ethoxylates include linear alkyl phenols of about 8 to about 10 carbon atoms, condensed with from about 3 to about 20 ethylene oxide groups. An especially preferred nonionic alcohol ethoxylate is a nonylphenol condensed with 10 ethylene oxide groups. Another preferred nonionic surfactant suitable for use in the composition of this invention is an ester of oleic acid and sorbitan. The preferred esters contain about 5 to about 20 moles of ethylene oxide, most preferably about 5 moles of ethylene oxide. Especially preferred are ethoxylated nonylphenols, for example, that are sold under the trademark Tergitol NP-10 and polyoxyethylene sorbitan monooleates, for example, that are sold under the trademark Tween 80.

From about 2 to about 5 wt. % of a nonionic surfactant is to be used in the composition in accordance with the present invention, more preferably from about 2 to about 3 wt. % of the composition.

The composition of the present invention includes also a weak organic acid in an amount sufficient to impart to the composition the desired pH. Any suitable weak organic acid that is soluble in the composition can be used. Examples of such acids include acetic acid and hydroxyacetic acid. It is preferred to use citric acid.

The amount of weak organic acid used will depend on the particular pH desired and on the particular acid used. It is believed that, for most applications, the amount of acid will generally be about 1 to about 2 wt. % of the composition. In particularly preferred form, the weight ratio of the acid to the cationic surfactant is about 1 to about 5.

The neutral aqueous cleaning composition in accordance with this invention has a pH of about 6 to about 8, more preferably from about 6.5 to about 7.5. The pH of the composition is measured at ambient temperature.

Any suitable means can be used to bring into contact the cleaning composition of the present invention and the substrate to be cleaned. For example, the cleaning composition can be utilized in spray-in-air, ultrasonic, immersion, or spray-under-immersion applications. Available aqueous cleaning equipment can be used in the cleaning process. Examples of commonly used equipment in industrial processes for use in the practice of the present invention includes batch or in-line machines with one cleaning tank and from 1–3 water rinses, with spray-under-immersion and ultrasonics in all sumps.

Although the cleaning composition can be applied at ambient temperatures, it is preferred to use it in heated form, for example, at a temperature of about 100° F. to about 180° F. A preferred temperature is about 150° F. to about 180° F. Cleaning time is dependent on different factors, for example, the type and quantity of soil and the temperature of operation. It is believed that a contact time of about 1 to about 10 minutes will be satisfactory for most applications.

The cleaning composition of the present invention may be used in neat (undiluted) form or it can be diluted, for example, with up to about 95% water, depending on the involved cleaning application. In its diluted form, the clean composition still retains the significant advantages of cleaning efficiency combined with substrate surface brightening. The ability to dilute the present invention to a composition which can, for example, comprise as little as 5% composition of the present invention and as much as 95% water offers an additional economic advantage, as water is the least costly ingredient in the cleaning composition.

An important characteristic of the neutral pH aqueous cleaning composition of the present invention is that it is capable of effectively removing a broad array of soilants from a broad array of metallic and non-metallic substrates.

This aqueous cleaner can be used effectively in large-scale industrial cleaning processes, in smaller-scale laboratory or cleaning processes, or for home use in general purpose cleaning processes. Therefore, an advantage of the present invention is its wide-ranging applicability, as it can be used to clean a broad array of substrates which are contaminated with a broad array of soils.

The cleaning composition of the present invention offers advantages over neutral aqueous cleaners of the prior art in that it offers a combination of properties not previously demonstrated by a neutral aqueous cleaning composition. It offers the significant advantage of being able to brighten sensitive metals such as aluminum, brass, and copper, while retaining the ability to effect large soil loading capacity, efficient soil removal, and corrosion inhibition.

The cleaning composition of the present invention can be used effectively to clean a wide variety of substrates, including delicate substrates. It is especially gentle with the delicate substrates of soft and highly sensitive metals. It is compatible with the soft metals aluminum, brass, copper, nickel, and tin, and the highly sensitive metals nitralloy steel, 52100 steel, and stress proof steel (ASTM A3111 Class B).

The composition of the present invention thus has the ability to remove a wide variety of soils from a broad array of substrates (including soft and highly sensitive metals), retain a large amount of the removed soil without needing to change the cleaning composition, reverse significant surface corrosion and inhibit additional corrosion on the substrate to be cleaned, while simultaneously brightening the surface of the metal being cleaned.

The following examples are illustrative of the cleaning composition of the present invention.

EXAMPLES

Example 1 and 2

The cleaning compositions of Examples 1 and 2 were prepared by mixing the ingredients in the proportions stated below.

| Ingredient | Ex 1 | Ex 2 |
|---|---|---|
| water | 50 | 50 |
| propylene glycol n-butyl ether | 4 | 4 |
| tripropylene glycol monomethyl ether | 38 | 37 |
| ethoxylated nonylphenol | 2 | |
| sorbitan monooleate | | 3 |
| 1-hydroxyethyl-2-oleylimidazoline | 5 | 5 |
| citric acid | 1 | 1 |
| pH | 7.0 | 7.0 |

Brightening

The following examples (3–5) illustrate the brightening ability of the cleaning composition of Examples 1 and 2 on aluminum, copper, and brass.

Example 3

Aluminum

Part of a cast aluminum engine block was cleaned. The block was constructed of porous aluminum cast in a sand mold, and had very complex geometry. The cleaning compositions of Examples 1 and 2 removed a large portion of the sand while brightening the aluminum.

Example 4

Copper

The cosmetic effects of the cleaning composition of Examples 1 and 2 on copper were tested by cleaning small copper pieces. The copper was brightened appreciably by the cleaning composition of the present invention, and looked as though it had been polished.

Example 5

Brass

Brass valve blocks were cleaned in a mixture of 90% water and 10% each of the cleaning compositions of Examples 1 and 2 at 160° F. for four minutes. Prior to cleaning, the valves had been considerably tarnished by the production process and were also coated in processing oil. After cleaning, the valves were considerably brightened and were cleaned of oil. The brightening effect was strong enough as to be comparable to an acidic brightening step and made the valves acceptable for direct shipment.

Substrate Compatibility

The following examples (5–6) illustrate the ability of the cleaning compositions of Examples 1 and 2 to be compatible with both aluminum and steel substrates. This compatibility is demonstrated by the lack of surface attack on aluminum and the ability to prevent corrosion on steel.

Example 5

Aluminum Coupon

The following procedure was used to evaluate the effect of the cleaning composition of Examples 1 and a comparative alkaline cleaner on the surface of aluminum substrates. An aluminum coupon was immersed in a solution of each of the compositions of Examples 1 and the comparative alkaline cleaner. The solution having immersed therein one aluminum coupon was then heated to 140° F. Example 1 was diluted to 10% in water. The alkaline cleaning composition was diluted to 4% in water. The results obtained are illustrated below.

| Action on Substrate | Ex 1 | Alkaline |
|---|---|---|
| aluminum surface attack observed | none | immed |
| attack | | |
| weight loss after 15 mins (%) | 0.005 | 0.08 |
| additional wt loss after 1 hr (%) | none | 0.2 |

As can be seen by the data reported above, the neutral aqueous cleaning composition in accordance with Example 1 of the present invention offers performance benefits when compared to the alkaline cleaner. The aluminum substrate cleaned by the alkaline cleaner suffered much more surface attack than did the aluminum substrate cleaned by the neutral cleaner of the present invention.

Example 6

Corrosion Inhibition

The following procedure was used to evaluate the corrosion-inhibition properties of the composition of Example 1. Samples consisting of one-half of a corrosion-prone steel coupon were immersed in beakers containing variously the composition of Example 1 or of a comparative solution of alkaline cleaner. The other one-half of the coupon was left exposed to air. The coupons were removed from the compositions at the first evidence of rust on the immersed side, and then they were dried. The data listed below shows the corrosion-inhibiting properties of the composition of Example 1, since the side of the steel coupon immersed in the composition of Example 1 suffered no rust.

| Appearance of Rust After Immersion | Ex 1 | Alkaline |
|---|---|---|
| non-immersed side | seconds | seconds |
| immersed side | none | seconds |

Soil Removal

The following examples (7–11) illustrate the effective soil removal cleaning capability of the cleaning composition of Example 1 of the present invention. In these examples, the cleaning compositions of Example 1 and have been demonstrated to remove effectively various types of soils from various substrates.

Example 7

Steel Coupon

The following procedure was used to evaluate the cleaning efficiency of the composition of Examples 1 and 2. A steel coupon was coated with oil. The oil-coated coupon was then immersed in a beaker of the cleaning composition to be evaluated and placed in an ultrasonic bath for a prescribed period of time. Following the wash, the coupon was rinsed, dried, and examined visually for cleanliness. In subsequent experiments, the ultrasonic wash time was increased until the coupon was cleaned completely by this procedure. The cleaning composition of Example 1 cleaned effectively steel coupons coated with stamping oil, quenching oil, and lubricating grease.

Example 8

Steel Weights

Two 500 g laboratory balance weights were cleaned. The weights are cylinders made of polished stainless steel with a threaded hole in the top through which an adjustable weight could be fitted. The hole was blind at one end with approximately ¼" inner diameter with buffing compound packed into the threads. The buffing compound had been on the part for over a month.

The cleaning compositions of Example 1 and 2 cleaned the part after 10 minutes in a bench top ultrasonic tank at roughly 155° F. The only other cleaner that appeared to perform as well as Example 1 was W. R. Grace's Daraclean 212 Buffing compound Remover. Among the cleaners that failed to clean were Brulin's Buff Brite Buffing Compound Remover, and several other alkaline aqueous cleaners. clean were Brulin's Buff Brite Buffing Compound Remover, and several other alkaline aqueous cleaners.

Example 9

Steel Transmission Parts

The parts to be cleaned are steel cylinders from automotive transmissions roughly 1 inch high and ¼ inch in diameter. There is a screen at the top of the cylinder and two small holes near the bottom. The cylinders are packed with baked-on grease and oil. The cleaning composition of the present invention made significant progress in cleaning these parts, in comparison to other cleaners.

Example 10

Glass Plate

The cleaning composition of Example 1 was tested to evaluate its ability in removing an organic haze and some particulate from plate glass. A 5 minute wash in the cleaning composition of Example 1 was followed by a rinse. There was no perceptible residue on the plate. Among the cleaners that failed were several alkaline aqueous cleaners and an acid wash.

Example 11

Dental Implants

Small dental implants with blind holes were liberally coated with a heavy cutting oil. The oil fluoresces under UV light, making small traces easily detectable. The cleaning composition of Example 1 successfully cleaned the parts in 8 minutes. Other cleaners had been used with 10 minute wash cycles without successfully cleaning the parts. Among the cleaners that failed to clean these parts were Kyzen HC and several alkaline cleaners.

Soil Loading

The following example illustrates the soil-loading capacity of the cleaning composition of Example 1.

Example 12

Soil Loading Capacity

The following procedure was used to test the soil loading capacity of the composition of Example 1. Oil loading is accomplished by either emulsification or physical means. One-inch by two-inch parts coated with oil were cleaned in a 10% solution of the cleaning composition in water until the parts could no longer be cleaned (visually soil-free) in one and a half times the original time for complete cleaning. The weight of oil added to the bath was monitored.

| Range of Capacity for Example 1 | |
|---|---|
| amount of organic solvent present (%) | 4.2 |
| capacity (%) | 1.4–8.8 |
| oil amt (lb/15 gal tank) | 1.2 |
| # of 1" × 2" parts cleaned | 3600 |

In summary, it can be said that use of the neutral pH aqueous cleaning composition of the present invention offers the following advantages:

(a) broad substrate range, including metallic and non-metallic;

(b) broad soil range, including organic and inorganic;

(c) environmental advantages, including non-ozone depleting components and efficient waste disposal;

(d) aluminum, brass, and copper brightening;

(e) large soil loading capacity;

(f) corrosion inhibition;

(g) no aluminum surface attack; and (h) high degree of cleaning efficiency.

Accordingly, the composition of the present invention offers numerous advantages relative to various cleaning compositions of the prior art.

What is claimed is:

1. An aqueous cleaning composition having a pH of about 6 to about 8 and comprising a solution of: (A) about 30 to about 68 wt. % water; (B) about 25 to about 55 wt. % of organic solvent for dissolving adherent soils from a substrate and for stabilizing the cleaning composition; (C) 5 to about 10wt. % of an imidazoline-based cationic surfactant for dissolving adherent soils from a substrate and for brightening the surface of soft metals; (D) about 1 to about 5 wt. % of a nonionic surfactant for maintaining the cationic surfactant in solution; and (E) a weak organic acid for imparting to the composition the desired pH; wherein said composition is substantially free of any material which has an ozone-depletion factor of greater than about 0.15 and wherein said composition is substantially free of any material which would tend to form a solid with any of the ingredients comprising the composition.

2. A composition according to claim 1 wherein the organic solvent consists essentially of about 20 to about 40 wt. % of a water-soluble glycol ether and about 4 to about 15 wt. % of a water-insoluble glycol ether.

3. A composition according to claim 2 wherein the water-soluble glycol ether consists essentially of tripropylene glycol monomethyl ether.

4. A composition according to claim 3 including about 35 to about 38 wt. % of the tripropylene glycol monomethyl ether.

5. A composition according to claim 2 wherein the water-insoluble glycol ether consists essentially of propylene glycol n-butyl ether.

6. A composition according to claim 5 wherein the water-soluble glycol ether consists essentially of tripropylene glycol monomethyl ether and the water-insoluble glycol ether consists essentially of propylene glycol n-butyl ether.

7. A composition according to claim 1 wherein the cationic surfactant consists essentially of 1-hydroxyethyl-2-oleylimidazoline.

8. A composition according to claim 2 wherein the cationic surfactant consists essentially of 1-hydroxyethyl-2-oleylimidazoline.

9. A composition according to claim 1 wherein the nonionic surfactant is selected from the group consisting of a nonionic alcohol ethoxylate and an ester of oleic acid and sorbitan.

10. A composition according to claim 9 wherein the nonionic alcohol ethoxylate is a linear alkyl phenol of about 8 to about 10 carbon atoms, condensed with from about 3 to about 20 ethylene oxide groups.

11. A composition according to claim 9 wherein the nonionic alcohol ethoxylate is a nonylphenol condensed with 10 ethylene oxide groups.

12. A composition according to claim 2 wherein the nonionic surfactant consists essentially of an ethoxylated nonylphenol.

13. A composition according to claim 9 wherein the ester of oleic acid and sorbitan consists essentially of polyoxyethylene sorbitan monooleate.

14. A composition according to claim 1 wherein the weak organic acid consists essentially of citric acid.

15. A composition according to claim 1 wherein the pH of the composition is about 6.5 to about 7.5.

16. A cleaning composition consisting essentially of about 5 to about 10 wt. % of the composition of claim 1 and about 90 to about 95 wt. % of additional water.

17. A cleaning composition consisting essentially of about 5 to about 10 wt. % of the composition of claim 2, and about 90 to about 95 wt. % of additional water.

18. A method of removing soil from a substrate comprising the step of contacting the substrate with the cleaning composition of claim 1.

* * * * *